United States Patent [19]

Gutierrez

[11] Patent Number: 4,588,179

[45] Date of Patent: May 13, 1986

[54] CARD COLLATOR WITH BOTTOM HOLE PNEUMATIC PULLER EXTRACTOR

[76] Inventor: Thomas Gutierrez, 266 N. Cypress St., San Jose, Calif. 95117

[21] Appl. No.: 692,290

[22] Filed: Jan. 16, 1985

[51] Int. Cl.[4] ..... B65H 39/02

[52] U.S. Cl. ..... 270/58; 271/102

[58] Field of Search ..... 270/58; 271/12, 99, 271/102, 107

[56] References Cited

U.S. PATENT DOCUMENTS

| | | | |
|---|---|---|---|
| 1,979,153 | 10/1934 | Guenther | 271/102 |
| 2,335,064 | 11/1943 | Kabel | 271/102 |
| 2,336,499 | 12/1943 | Murch et al. | 271/102 |
| 3,002,751 | 10/1961 | Wheeler et al. | 271/99 |
| 3,007,696 | 11/1961 | Wheeler et al. | 271/99 |
| 3,019,012 | 1/1962 | Sanford | 271/107 |
| 3,401,609 | 9/1968 | Nelson et al. | 271/107 X |
| 3,536,570 | 10/1970 | Holstein | 271/102 |
| 4,154,438 | 5/1979 | Seragnoli | 271/102 X |
| 4,463,942 | 8/1984 | Newsome | 271/102 |

FOREIGN PATENT DOCUMENTS

| | | | |
|---|---|---|---|
| 508728 | 1/1955 | Canada | 271/102 |
| 1257796 | 1/1968 | Fed. Rep. of Germany | 271/102 |
| 940198 | 10/1963 | United Kingdom | 271/102 |

*Primary Examiner*—E. H. Eickholt

*Attorney, Agent, or Firm*—Thomas Schneck

[57] ABSTRACT

A collator for flexible cards which includes a tray for supporting cards which are fed into a chute by action of a pneumatic puller. Pairs of opposed chutes angularly oriented toward linearly movable bins such that bins can collect cards from opposed chutes and then be indexed to an adjacent pair of opposed, fixed chutes. The pullers are carried by reciprocating arms associated with opposed chutes. A hole in each chute allows a puller to pull a card and then be withdrawn from the card stack, but has a size such that a card is freed from the puller and falls in the chute. Cards are supported in the stack by rubs in a card tray such that the bottom-most card is accessible to a puller. First a card drops into a bin from one side, then the other side.

15 Claims, 8 Drawing Figures

CARD COLLATOR WITH BOTTOM HOLE PNEUMATIC PULLER EXTRACTOR

TECHNICAL FIELD

The invention relates to collators and more particularly to a collator for flexible cards, such as playing cards.

BACKGROUND ART

Vacuum collators are known. In such a device, low-pressure pipes, known as pullers or suckers are used to pick up a single article from a supply stack and transfer the article to a conveyor. Such a device is shown in U.S. Pat. No. 3,019,012 to Sanford.

In many prior art devices, wear particles tend to soil cards before use. Sometimes this problem arises from conveyors, moving cards to a stack.

An object of the present invention was to devise a multi-bin sorter for flexible cards which would keep cards clean and at the same time be simple to make and use.

SUMMARY OF THE INVENTION

The above object was achieved using gravitational transfer of cards from a stack to a bin. A card is pulled from a stack by a vacuum puller attaching to the bottommost card held by a pair of ribs. The puller extends through a hole in a chute near the bottom of the card stack. As the puller is retracted through the chute, the hole is large enough to allow the puller to pass therethrough, but not large enough to allow the card to pass. Instead, the card slides down the inclined chute and sails onto a bin at the bottom of the chute. The puller which has been withdrawn is now rocked forward to again contact the card stack and repeat the process.

A pair of such chutes, card trays for holding card stacks and pullers can be disposed opposite each other, with the pullers supported on upright bent arms from a common shaft. As the shaft rocks back and forth, first one puller, then the other, pulls a card from the card stack, deposits it on a chute and is separated by retraction of the puller past the chute, allowing the card to move downwardly and into a waiting bin.

By aligning a plurality of pairs of such opposed chutes in adjacent fashion, thereby forming a series of trays, chutes and bins, collating of a large number of cards may be rapidly accomplished. Upon receiving a card from opposed chutes, the bins under-neath the chutes are indexed by a distance roughly corresponding to the width of a bin such that a new bin is in the trajectory of each chute for receiving a card. An endless conveyor of bins may be used to collect the collated cards.

Using the present invention, flexible cards such as playing cards and the like may be collated quickly, cleanly and at modest expense.

BEST MODE OF CARRYING OUT THE INVENTION

Figure 1:
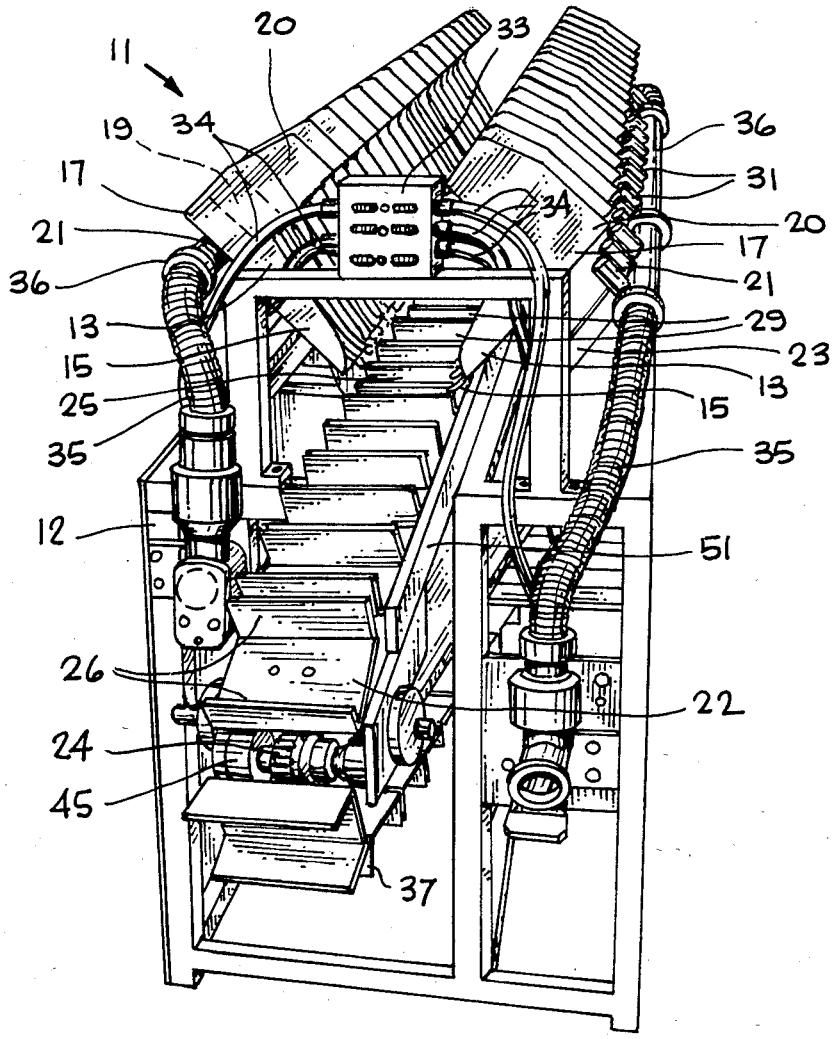
FIG. 1 is a perspective end view of the collator of the present invention.
Figure 2:
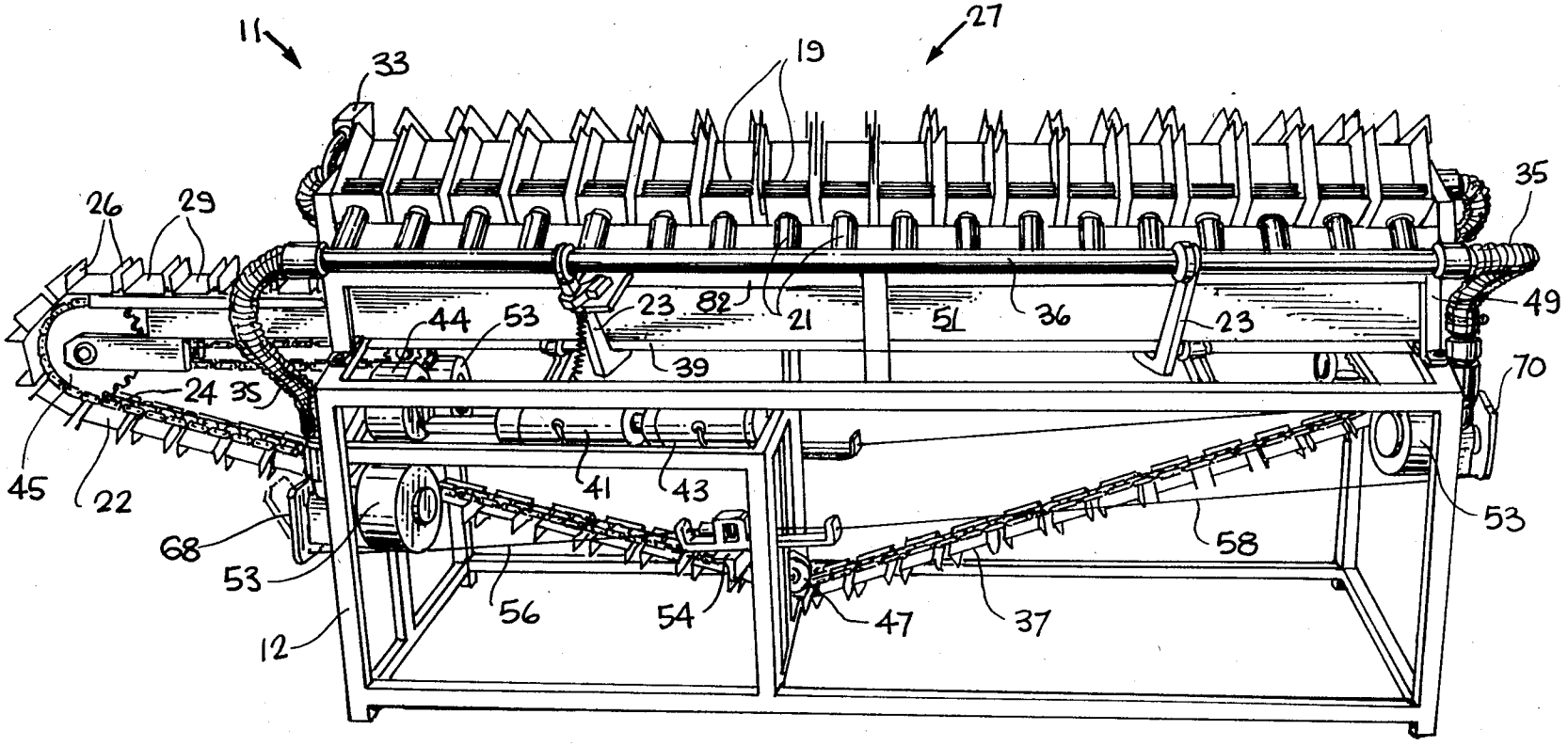
FIG. 2 is a perspective side view of the collator of FIG. 1.

With reference to FIGS. 1 and 2, the collator of the present invention is shown to have multiple downwardly inclined chutes 13, each of which has a lower end 15 and an upper end 17. Above each chute a stack of cards 19 is held within a tray 20. The chutes are inclined at an angle of about 45° to the horizontal, with the card-holding trays approximately normal or 90 to this angle. The purpose of this arrangement is to allow cards held in the tray to be pulled down flat against a chute. The angle of the chute is selected so that cards will readily slide down the chute.

A puller 21 is a low-pressure pipe which can come into contact with the bottommost card in a card stack in a manner described below. The puller is connected to a pipe 36 and an arm 23, the arm controlling puller motion. Below and slightly offset from each chute, a bin 25 is disposed in a manner to catch cards falling from the chute. The bin is formed by a bottom plate 22 connected to a chain 24. The chain forms an endless loop for circulating a series 29 of bins beneath the fixed chutes. Connected to each plate is a pair of parallel spaced-apart sidewalls 26 which serve to confine cards deposited onto the plate and form a bin which is open on opposite ends for removal of the cards, once the cards are past the chutes.

A series of similar chutes, trays and bins forms the collator. The number of such assemblies corresponds to the number of cards to be collated. A series 27 of chutes and trays is held in fixed position by base 12 while the series 29 of bins is incrementally moved after receiving a card from each chute by action of the series 31 of pullers. At one end of the base, a control panel 33 is mounted with switches for controlling power to the apparatus and status lights for motors and hoses. Cables 34 carry power to the motors, as well as carrying lines which indicate status or perform control functions. Hoses 35 are flexible conduits which pump air from the pullers to exhaust motors. The motors are high r.p.m. vaccum type motors, with the connected air hoses having a diameter of approximately one and one half inches.

In the illustrations of FIGS. 1 and 2 it should be realized that there are two perpendicular motions occurring at the same time. The first motion is the linear motion of conveyor 37, incrementing bins past the chutes. The second motion, perpendicular to the first is the reciprocal motion of the arms 23 moving the pullers 21 to the card stacks 19. A first motor 41 provides power to a gear box 44 which propels chain 24 and hence conveyor 37. A second motor 43 transfers power to a reciprocating shaft 39 which moves arms 23. These arms in turn carry the pipe 36 to which the pullers 21 are connected. Chain 24 is seen to be a closed loop about the first pulley 45 at one end, a second pulley 47 in the undercarriage of the base and a third pulley 49 at the opposite end. Pulley 45 is extended a distance beyond base 12 so that workers can gather collated cards from the open bins.

While the bins traverse the body of the machine beneath the chutes, the vertical spaced-apart parallel stationary barriers 51 form end walls for these bins, keeping cards from falling out. Once the bins get past these barriers, support is lacking and the card should be removed. Also seen in the undercarriage of the apparatus are the air pumps 53 maintaining a vaccum pressure in hoses 35. Negative pressure is applied to the hoses only during the card-pulling operation. This is controlled by a solenoid 54 having attached cables 56 and 58 connected to the hinged flaps 68 and 70. The solenoid is tripped by a micro-switch 82 which is activated when arm 23 reaches a pre-determined position corresponding to the passage of pullers 21 through holes in the chutes. Once the pullers pass through the chutes, there is no need for vacuum pressure and so, in order to avoid the buildup of static charge on the pullers, a valve diverts vacuum pressure so that the air hoses can return momentarily to atmospheric pressure. When microswitch 82 is tripped, solenoid 54 is activated, causing the cables 56 and 58 to be drawn together, pulling the flaps 68 and 70 in a direction such that they open a valve connected to air pumps 53, causing the pumps to draw air from the atmosphere, rather than from the hoses. The flaps are held in the open position until the arm causes a puller to pass through a hole at which time the microswitch is released. At that time the solenoid is also released and the flaps are then closed. This causes negative pressure in the hose for pulling another card.

Figure 3:
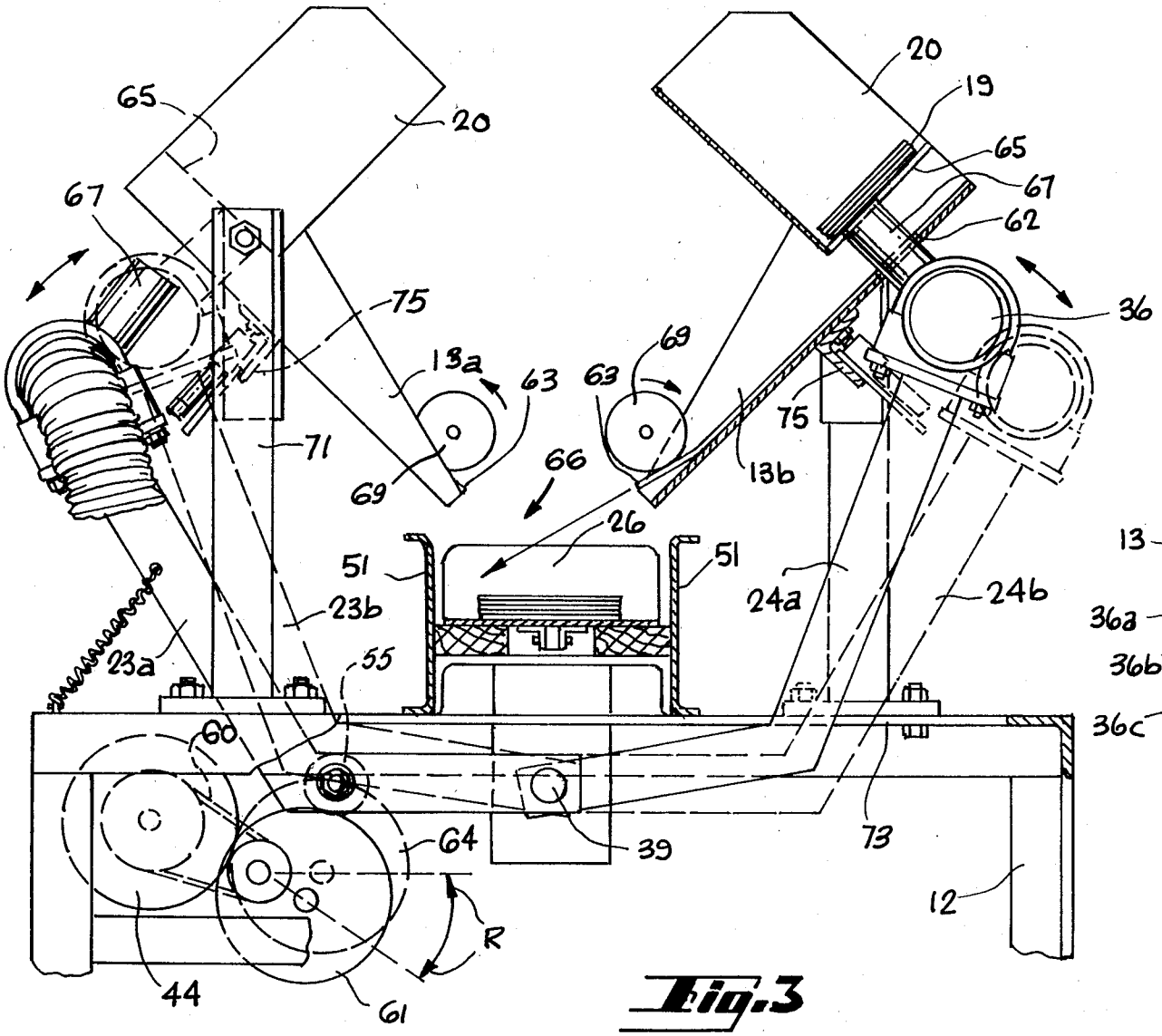
FIG. 3 is a side view illustrating details of opposed collator members.
Figure 4:
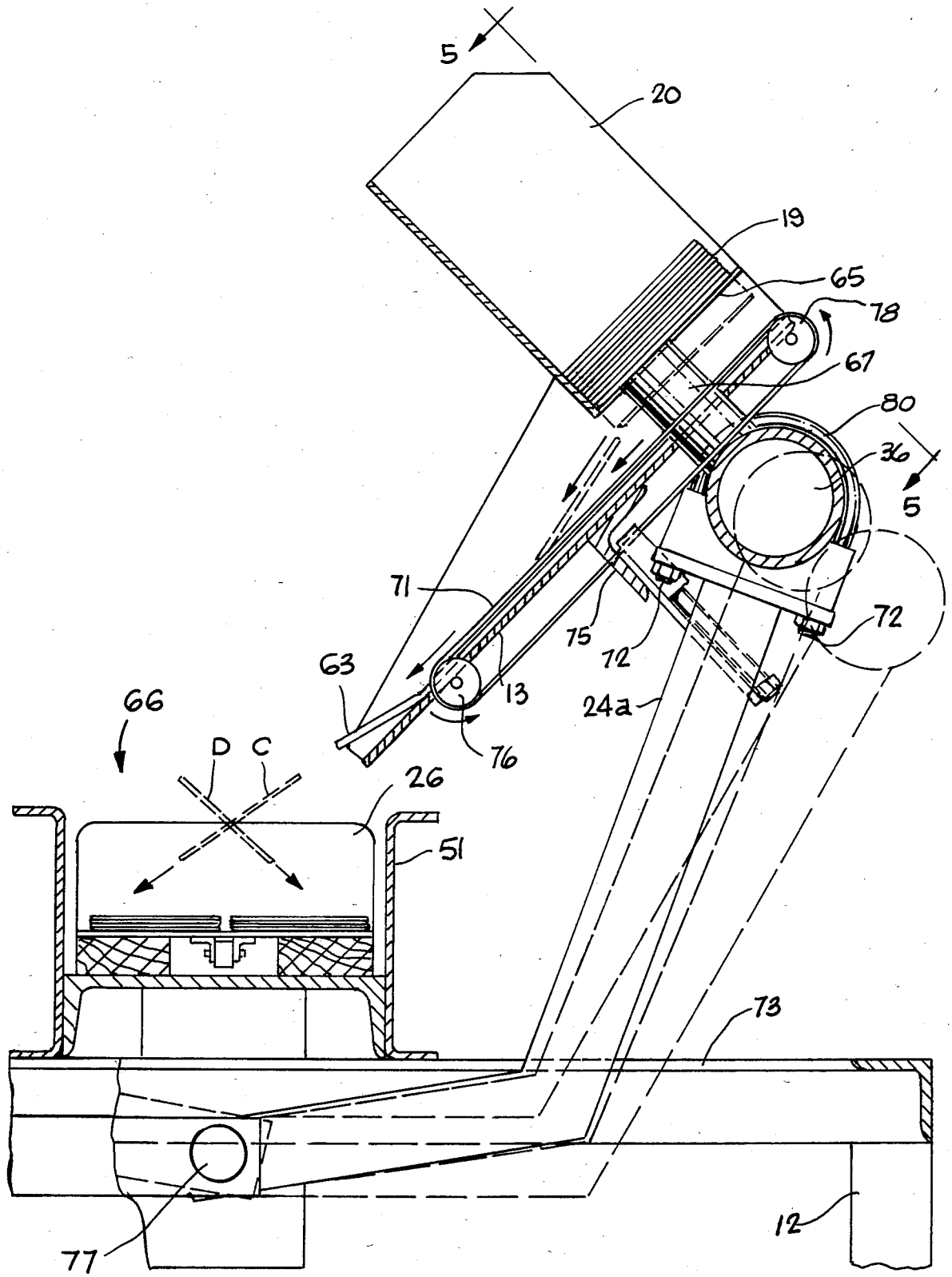
FIG. 4 is an enlarged view of one of the collator members illustrated in FIG. 3.

The manner of depositing cards in a bin may be seen with reference to FIGS. 3 and 4. Cam 61 is driven by power from gear box 44 transferred by belt 60. A small wheel, Cam follower 55, rides on cam 61. The cam follower 55 is mounted on upright arm **23*a* and causes the arm to move up and down in accord with the apparently eccentric motion of the cam 61 indicated by dashed lines 64 and the arrows R. The arm 23*a* carries puller 67 in the retracted position since the follower 55 is in its lowermost position. When the follower moves to its uppermost position, the arm has the position indicated by lines 23*b*, moving the puller 67 to its forwardmost position. Reciprocating motion is transferred from arm 23*a* to arm 24*b* by means of a shaft 39 to which the two arms are conneted. The arms are connected such that one puller is forward contacting a card stack when the opposite puller is retracted. In this case, arm 24*a* is forward when arm 23*a* is retracted. Similarly, when the arms reciprocate, they have the positions indicated by arms 23*b* and 24*b***, shown in dashed lines.

The chute **13*b* is seen to have a lip 63, resembling a "ski jump" for cards sliding down the chute. Once a card is pulled from stack 65 by puller 67, it is released when the puller passes through hole 62 in the chute. The hole is large enough for the puller to pass through, but not large enough for the card. Rather, the card is blocked and once the puller has moved away, the card slides down the chute, over lip 63 and into the bin 66. A roller 69**, driven by a motor not shown, may be used at the end of each chute to provide an appropriate and adjustable amount of departure force at the end of the chute. Different types of cards may require different departure forces.

In FIG. 4, a band-type of conveyor belt 71 may be seen to be trained about pulleys 76, 78, one of the pulleys being driven by a motor, not shown. Belt 71 guides cards down the chute in a controlled manner, to the end of the chute, whereupon gravity then takes over, sending a card in an airborne trajectory, as seen in the card C and a card, D, coming in the opposite direction from an oppositely disposed card stack. The speed of belt 71 is controlled to provide the appropriate amount of departure force so that a card will land in a desired pile. FIG. 4 also shows that a single bin can hold two stacks of short cards, side by side between sidewalls 26.

Figure 5:
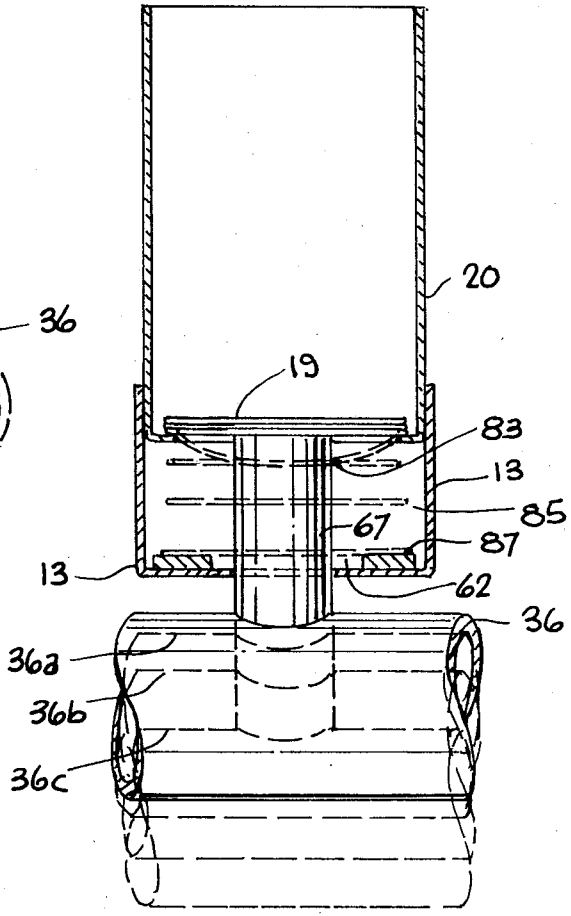
FIG. 5 is a detailed operational view of a puller, taken along lines 5—5 in FIG. 4.

With reference to FIGS. 4 and 5, cards are supported in card stack 19 by means of mutually facing ribs 65 which are outwardly projecting dimples in the sidewall of card tray 20. These ribs extend far enough inwardly to support the stack, yet allow puller 67 to remove a card by flexing the card. Puller 67 experiences a constant negative pressure which is carried through pipe 36. The pipe is held in place by means of a U-bracket 80 connected to arm **24*a* by means of fasteners 72. The arms are supported from shaft 77 which is connected to table 73 which, in turn, is supported by base 12. It will be seen that tray 20 is connected to chute 13, as by welding so that one chute is associated with one tray. The chutes are supported by a bracket 75 which runs the length of the frame and is connected to parallel end members above the table 73**.

In FIG. 5, the hole 62 is seen to provide clearance for puller 67 in the bottom wall of chute 13. Puller 67 is seen in contact with the bottommost card in stack 19 due to the forward position of the puller. As the puller is retracted, indicated by the dashed lines **36*a*, the bottommost card flexes as it is pulled from the stack, as indicated by dashed lines 83. Upon further retraction of the puller, as indicated by the dashed line 36*b*, the card is pulled free of the stack, indicated by dashed lines 85, showing that the card is now flat. Upon still further retraction, indicated by dashed lines 36*c*, the card is brought to rest against the bottom wall of the chute, shown by the dashed lines 87**, while the puller continues its motion past the hole. The card is now free to slide down the chute and promptly belongs its downward trajectory. As soon as its calculated flight time has elapsed, the bin is incremented a linear distance so that the bin is now beneath a new chute or pair of opposed chutes. In the case of opposed chutes, time is allowed for two cards to drop into the bin, before the bin is incremented.

Figure 6:
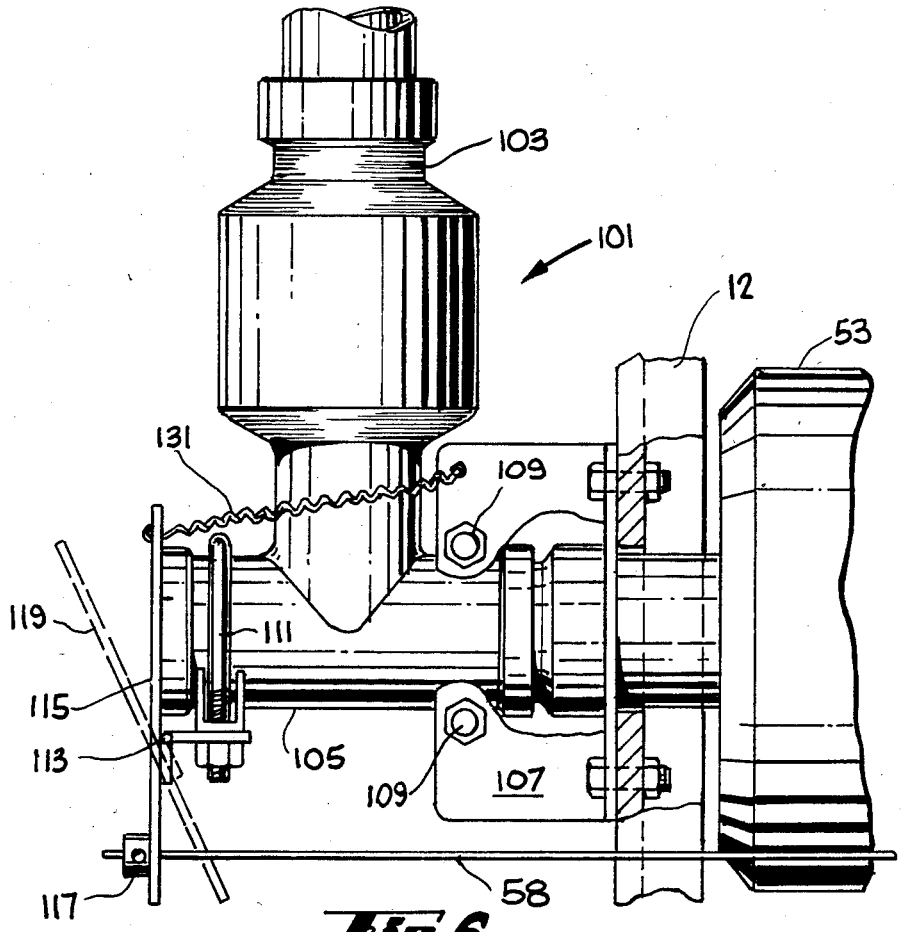
FIG. 6 is a side view of an air diversion valve.

With reference to FIG. 6, air diversion valve 101 is seen to have an upright section 103 connected to a feed section 105 with which the upright section forms a tee. The feed section is connected to air pump 53 which is mounted to base 12 by screws and nuts. The valve 101 is secured in place by bracket 107 which is connected to the base and has a U-shaped collar 109 extending around the feed section. A similar collar 111 supports a hinge 113 to which is mounted a flap 115. The flap has a bottom end connected to cable 58 which is secured in place by nut 117. When the solenoid pulls inwardly on cable 58, the flap 115 rotates, to the position indicated by the dashed lines 119. When the solenoid releases cable 58, a spring 121 returns the flap to its initial position. The distant end of the spring is secured to bracket 107.

Figure 7:
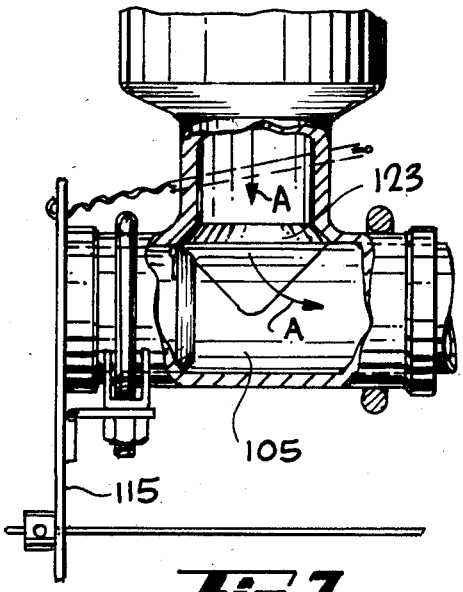
FIGS. 7 and 8 are side cutaway views illustrating the operation of the air diversion valve shown in FIG. 6.

In FIG. 7, the interior of feed section 105 has a poppet 123 which is spring biased upwardly, by a spring not shown. When the flap 115 is in its upright or closed position the negative pressure in feed section 105 pulls the poppet downwardly, against the spring allowing air to pass around the poppet, as indicated by arrows A.

Figure 8:
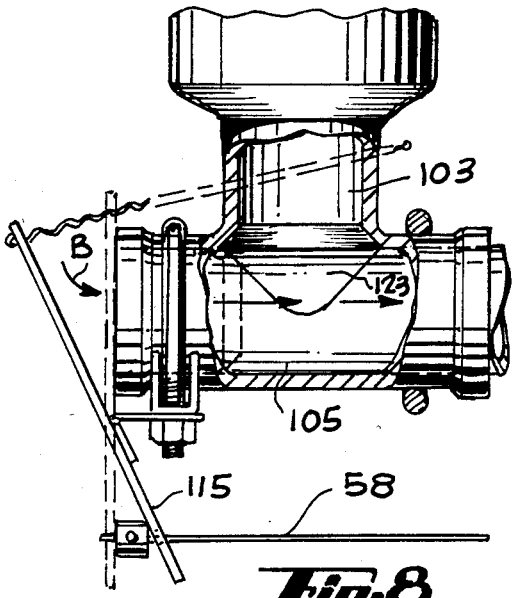

In FIG. 8, the flap 115 is shown to be pulled open by cable 58 allowing entrance of ambient air, indicated by arrow B into feed section 105. Poppet 123 is now pushed upwardly by the spring, closing off upright section 103 from negative pressure arising from the pump. In review, the reason for closing off the upright section from negative pressure is to limit the buildup of static charge on the pullers which has been found to occur When the pullers experience negative pressure at all times. Now, by releasing negative pressure during approximately one-half of the cycle, static charge is limited at the pullers. Such static charge was previously transferred to the cards and prevented the cards from freely sliding down respective chutes. This is necessary in order that cards arrive at desired bins at the scheduled time.

The present invention provides for a very rapid and clean means for collating flexible cards.

I claim:

1. A collator for cards comprising, means for supporting a stack of flexible cards in a manner such that the bottom of the stack is at least partially accessible, a pair of opposed chutes, each with an associated means for supporting a stack of flexible cards, each chute having a lower end and an upper end, each upper end near an associated stack of cards, each chute mounted in spaced relation relative to the bottom of the stack, each chute defining a hole therein below the card stack, a pair of opposed movable pneumatic pullers comprising low pressure tubes, each puller extendable through said hole in an associated chute for contacting the bottommost card in a card stack, the dimensions of each hole being less than the dimensions of a card whereby a hole stops a card when a puller is retracted through the hold, reciprocating arm means for moving opposed pullers into and out of contact with the accessible bottom of an associated stack of cards through respective holes in said associated chutes, means for providing motion to said reciprocating arm means, and bin means in card receiving relation relative to the lower end of each chute, said bin means having associated indexing means for indexing said bin means a predetermined distance relative to said chutes.

2. The collator of claim 1 wherein said means for supporting a stack of flexible cards comprises a pair of parallel, spaced apart walls adjacent to card edges, each wall having an inwardly extending rib facing a similar rib on an opposite wall, said ribs supporting the stack with an opening between ribs suitable for allowing a card to pass therethrough on flexing.

3. A collator for cards comprising means for supporting a stack of flexible cards in a manner such that the bottom of the stack is at least partially accessible, a series of parallel chutes, each with an associated means for supporting a stack of cards, each chute having a lower end and an upper end, each upper end near an associated stack of cards, each chute mounted in spaced relation relative to the bottom of the stack, each chute defining a hole therein below the card stack, a series of parallel movable pneumatic pullers comprising low pressure tubes, each puller extendable through said hole in associated chute for contacting the bottommost card in a card stack, each puller supported by an arm means for moving the puller into and out of contact with the accessible bottom said stack, the dimensions of each hole being less than the dimensions of a card whereby said hole stops a card when a puller is retracted through the hole, and a series of bins, one bin in card receiving relation relative to each chute, said bins having indexing means for indexing said bins a predetermined distance relative to said chutes.

4. The collator of claim 1 wherein said arm means moving said pullers is driven by cam means for providing rocking motion.

5. The collator of claim 3 wherein said series of bins includes means for incrementally advancing said bins from one chute to another in said series of parallel chutes.

6. The collator of claim 1 wherein said lowpressure tubes include valve means for selective application of low pressure.

7. The collator of claim 6 wherein said valve means is controlled by a solenoid, said solenoid actuated by a micro-switch sensing the position of said arm means.

8. A collator for cards comprising, a plurality of movable bins driven by a conveyor, said bins for holding collated cards, a pair of opposed chutes having lower and upper ends mounted at angles above the bins opposite each other, the chutes having dimensions for accommodating cards therein, with said angles arranged for providing a card trajectory from a lower end of each chute into one of said bins, thereby feeding cards along the chutes to the bins, a card holder tray mounted near an upper end of each chute at an upright angle thereto, said tray having opposite walls with ribs projecting inwardly therefrom, said ribs supporting a card stack, each chute defining a hole therein immediately below the card stack, pair of pneumatic pullers, comprising low pressure tubes, each puller extendable through the hole in each chute for contacting the lowermost card on a card stack, the dimensions of each hole being less than the dimensions of a card so that an associated chute will detatch a card from a puller as the puller is retracted through the hole, a pair of bent rocking arms, each arm supporting a puller for alternating contact with the card stack through respective holes, and means for providing motion to said rocking arms.

9. The collator of claim 8 wherein said low-pressure tube includes valve means for selective application of low pressure.

10. The collator of claim 8 wherein said valve means is controlled by a solenoid, said solenoid actuated by amicro-switch sensing the position of said arm means.

11. The collator of claim 8 wherein a plurality of pairs of opposed chutes are aligned with bins, each pair of opposed chutes feeding cards to one bin.

12. The collator of claim 8 wherein the means for providing motion to said rocking arms comprises a cam and a motor, one of the bent rocking arms adapted to follow the periphery of the cam.

13. The collator of claim 8 wherein said card holder tray is substantially perpendicular to an associated chute.

14. The collator of claim 8 wherein said conveyor includes means for incrementally advancing said bins from a first position associated with a first pair of chutes to a second position associated with a second pair of chutes and then to further positions associated with further pairs of chutes.

15. The collator of claim 8 wherein said conveyor comprises an endless belt providing sequential bins on a closed loop.

* * * * *